United States Patent [19]

Foster

[11] Patent Number: 4,657,214

[45] Date of Patent: Apr. 14, 1987

[54] COMPUTER MOUNTING STAND

[76] Inventor: Daniel F. Foster, 7160 S. Vine Cir. E., Littleton, Colo. 80122

[21] Appl. No.: 799,418

[22] Filed: Nov. 19, 1985

[51] Int. Cl.[4] ..... A47G 23/02

[52] U.S. Cl. ..... 248/176; 312/311; 108/102

[58] Field of Search ..... 248/176; 312/311; 108/102; 400/680, 682, 690, 691, 693; D1/129; D7/82

[56] References Cited

U.S. PATENT DOCUMENTS

| | | | |
|---|---|---|---|
| 693,124 | 2/1902 | Forney | 400/680 |
| 1,646,008 | 10/1927 | Butler | 312/311 |
| 2,814,545 | 11/1957 | Cornish | 312/311 |
| 3,227,505 | 1/1966 | Ambaum | 312/311 |
| 3,732,965 | 5/1973 | Mero | 400/682 |
| 3,844,395 | 10/1974 | Mero et al. | 400/328 |
| 4,313,112 | 1/1982 | Foster | 340/700 |
| 4,379,429 | 4/1983 | Gubbe et al. | 108/5 |
| 4,428,631 | 1/1984 | Cope et al. | 312/196 |
| 4,458,961 | 7/1984 | Browning | 312/196 |
| 4,483,572 | 11/1984 | Story | 312/322 |
| 4,496,200 | 1/1985 | Hagstrom et al. | 312/208 |

FOREIGN PATENT DOCUMENTS

| | | | |
|---|---|---|---|
| 3132015 | 10/1982 | Fed. Rep. of Germany | 108/17 |

OTHER PUBLICATIONS

Inmac Catalog 39th B edition, Aug. 1984, pp. 39–48.

IBM Technical Disclosure Bulletin, vol. 28, No. 2, Jul. 1985, pp. 747–750.

*Primary Examiner*—Andrew V. Kundrat

*Assistant Examiner*—Anthony Knight

*Attorney, Agent, or Firm*—Larson and Taylor

[57] ABSTRACT

A mounting stand for a cathode ray tube display screen and a keyboard work station includes a base having a screen platform mounted between two sides. A fixed copy support surface is also mounted between the two sides in front of the screen platform and is inclined downwardly. A movable copy support surface is hingedly mounted to the fixed copy support surface for moving between a use position and a nonuse position. In the use position, the copy support surface is at substantially the same angle of inclination as the fixed copy support surface so that a substantially continuous supporting surface is provided for copy material. In the nonuse position, the movable copy support surface is angled with respect to the fixed copy support surface. A suitable mechanism is provided for holding the movable copy support surface in the use position with the keyboard in front of the movable copy support surface during use. Preferably, the mounting stand includes a keyboard platform which is movably mounted to the base for horizontal movement in one embodiment and for horizontal and vertical movement in another embodiment between a use and a storage position. In the storage position, the keyboard platform is located within the base with the movable copy support surface in the nonuse position covering a portion of the keyboard platform. In the preferred embodiment, a caming mechanism is used to move the movable copy support surface between the two positions.

19 Claims, 6 Drawing Figures

COMPUTER MOUNTING STAND

FIELD OF THE INVENTION

The present invention relates generally to a computer mounting stand, and more particularly to a compact computer stand having a copy support surface.

BACKGROUND OF THE INVENTION

In U.S Pat. No. 4,313,112 (Foster), a particularly advantageous computer work station assembly is disclosed. The disclosed work station assembly includes a mounting apparatus for supporting copy material and a mounting apparatus for supporting a cathode ray tube display screen therebehind. Conveniently, a keyboard supporting surface is also provided in front of the mounting apparatus for supporting the copy material.

Disclosed in U.S. Pat. No. 4,483,572 (Story) is a console or stand for a modular data processing system. This stand includes a platform on which a display screen is mounted and from which two sides depend. A keyboard supporting platform is movably mounted to this platform so that the keyboard platform is moved between a raised and stored position underneath the display screen and a lowered, operative position.

In U.S. Pat. No. 4,496,200 (Hagstrom et al), a desk top keyboard display terminal having an articulated keyboard is disclosed. The keyboard terminal is movable from a latched position in front of the terminal to a latched position articulated over the edge of a desk. In the lowered position, a small copy holder is provided. Other copy holders or computer work stations are disclosed in U.S. Pat. No. 4,428,631 (Cope et al) and U.S. Pat. No. 4,458,961 (Browning). A telegraph transceiver with a horizontally retractable keyboard is also disclosed in U.S. Pat. No. 3,732,965 (Mero) and U.S. Pat. No. 3,844,395 (Mero et al).

SUMMARY OF THE INVENTION

In accordance with the present invention, a mounting stand including a base is provided for a computer having a cathode ray tube display screen and a keyboard work station. The base has two vertical sides and a screen platform mounted horizontally between these sides on which the display screen rests. A fixed copy support surface is also mounted between the sides in front of the screen platform. The fixed copy support surface is inclined downwardly away from the screen platform with the upper edge of the fixed copy support surface being located vertically with respect to the screen platform so that the display screen is above the fixed copy support surface and thus easily seen. A movable copy support surface is also provided which is hingedly mounted to the fixed copy support surface. The movable copy support surface is movable between a use position and a nonuse position. In the use position, the movable copy support surface is at substantially the same angle of inclination as the fixed copy support surface in order to form a substantially continuous supporting surface. In the nonuse position, the movable copy support surface is angled with respect to the fixed copy support surface. A holding means is further provided for holding the movable copy support surface in the use position. A keyboard supporting means is further provided for supporting the keyboard in front of the movable copy support surface when the movable copy support surface is in the use position.

In the preferred embodiment of the present invention, the keyboard supporting means includes a horizontal keyboard platform and a mounting means for mounting the keyboard platform for horizontal movement. This horizontal movement is from a use position with the keyboard in front of the movable copy support surface when the movable copy support surface is in the use position, to a storage position of the keyboard platform beneath the fixed copy support surface when the movable copy support surface is in the nonuse position. In the nonuse position of the movable copy support surface, the surface is inclined downwardly from the fixed copy support surface and acts as a cover to protect the keyboard on the keyboard platform. In an alternative embodiment of the present invention, the mounting means also mounts the keyboard for vertical movement as well so that the use position of the keyboard platform is vertically lower than the storage position.

In the preferred embodiment, the keyboard platform includes opposite sides. The mounting means then movably mounts the respective sides of the keyboard platform to respective sides of the base. In addition, the holding means includes a cam means for moving the movable copy support surface between the use position and the nonuse position and for holding the movable copy support surface in the use position. This cam means includes a cam surface mounted on the keyboard platform and a cam follower mounted on the movable copy support surface. Conveniently, there are two cam surfaces, with each cam surface being formed by the upper edge of respective sides of the keyboard platform. With this construction, there are also two cam followers with each cam follower located vertically above a respective cam surface. The holding means is then preferably a notch in each cam surface in which a respective cam follower descends to thereby hold the movable copy support surface in the use position. A spring means is conveniently used for resiliently urging the movable copy support surface to the nonuse position and for resiliently urging the cam followers into the respective notches. For the convenience of the user, a palm rest is also preferably located at the forward end of the keyboard platform.

In the embodiment where the keyboard platform moves vertically, the keyboard platform preferably includes a back and a stop means. The stop means extends rearwardly from the back so that the use position of the keyboard platform is where the stop means engages the table edge on which the base rests. A roller at the rearward and lowermost end of the keyboard platform is also preferably included in this embodiment.

With the present invention, a compact and comfortable mounting stand for a computer assembly is provided. In the storage position, the mounting stand fits comfortably on a secretarial "L" desk and in other office system work spaces. In use, however, the keyboard platform pulls out from the mounting stand and this action provides a full size copy support surface. It should also be noted that where the keyboard platform pulls out from the mounting stand, extra knee clearance is provided beneath the keyboard platform relative to the table or the like in which the mounting stand rests.

It should also be appreciated that in the storage position, the mounting stand provides a cover or protector for the keyboard to reduce inadvertent damage to the keyboard.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
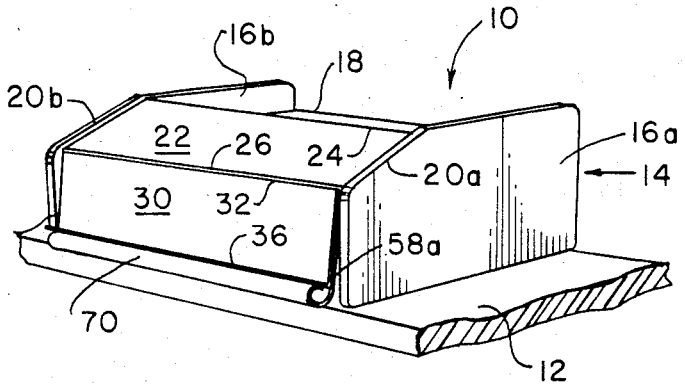
FIG. 1 is an elevation view in perspective of a mounting stand according to the present invention in a nonuse position.
Figure 2:
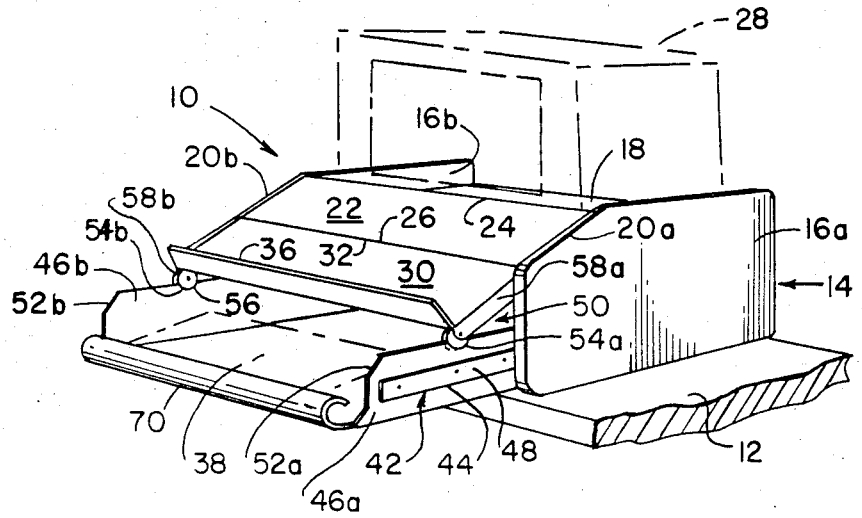
FIG. 2 is an elevation view in perspective of the mounting stand depicted in FIG. 1 in the use position.
Figure 3:
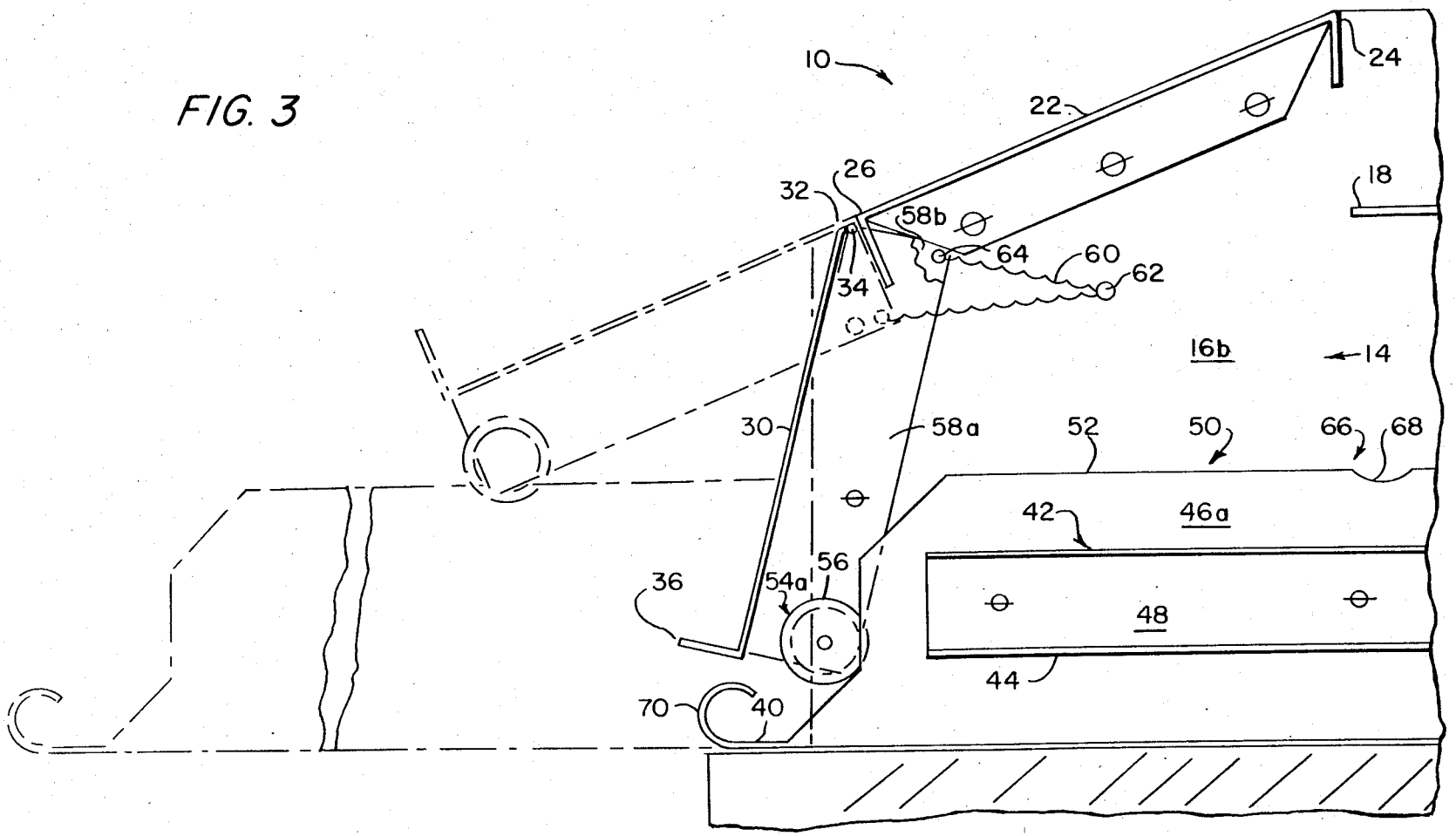
FIG. 3 is a side elevation view of the mounting stand depicted in FIGS. 1 and 2 with the side removed.

With reference now to the drawings in which like numerals represent like elements throughout the several views, a mounting stand 10 according to the present invention is depicted in FIGS. 1, 2 and 3. Mounting stand 10 is located on a table 12 or the like. Mounting stand 10 has a base 14 which includes sides 16*a* and 16*b*. Suitably mounted between sides 16*a* and 16*b* is a screen platform 18. Screen platform 18 is preferably horizontally oriented. If desired, a means (not shown) for adjusting screen platform vertically or angularly can be provided.

As shown, sides 16*a* and 16*b* include front inclined portions 20*a* and 20*b*, respectively. Mounted between inclined portions 20*a* and 20*b* at the same inclination is a fixed copy support surface 22. Fixed copy support surface 22 includes an upper edge 24 and a lower edge 26. Upper edge 24 is designed to be located at a vertical position relative to screen platform 18 so that the viewing area of a cathode ray tube display screen 28 (shown in phantom) mounted on screen platform 18 is easily viewable.

Pivotally mounted to lower edge 26 of fixed copy support surface 22 is a movable copy support surface 30. As shown best in FIG. 3, movable copy support surface 30 includes an upper edge 32 which is connected by a hinge means 34 to lower edge 26 of fixed copy support surface 22. Movable copy support surface 30 also includes a flange 36 at the lower edge thereof extending perpendicularly away from the main plane of movable copy support surface 30.

Movable copy support surface 30 is movable from a nonuse position as depicted in FIG. 1 and in solid lines in FIG. 3 to a use position as depicted in FIG. 2 and in phantom lines in FIG. 3. As shown best in FIG. 1, in the nonuse position, movable copy support surface 30 forms a suitable enclosure together with the remainder of base 14 and table 12. In the use position, movable copy support surface 30 together with fixed copy support surface 22 form a continuous surface on which copy material is suitably placed and held in position by flange 36.

Where movable copy support surface 30 is in a use position, a keyboard for use with display screen 28 is conveniently located just forward and out of the way of movable copy support surface 30. Where table 12 extends forward of sides 16*a* and 16*b*, it is a simple matter to simply rest the keyboard on table 12 during use. Then, during nonuse, the keyboard can be moved beneath fixed copy support surface 22 and base 14 for storage. However, in the preferred embodiment of the present invention, mounting stand 10 is located on table 12 which has an edge adjacent the forward edge of sides 16*a* and 16*b*. In this embodiment, a suitable keyboard 38 (shown in phantom) is located on a keyboard platform 40 which is mounted by a mounting means 42 for reciprocating horizontal movement as shown.

In this preferred embodiment, mounting means 42 includes a pair of guide mechanisms 44 (only one of which is shown), with each guide mechanism 44 located between respective sides 16*a* and 16*b* of base 14 and respective sides 46*a* and 46*b* of keyboard platform 40. Each guide mechanism 44 includes a U-shaped slide such as U-shaped slide 48 attached to side 46*a*. Each U-shape slide is mounted to a bearing or roller assembly and is slidably received in a corresponding U-shaped channel which is secured to respective sides 16*a* or 16*b*. Such guide mechanisms are well known to those of ordinary skill in the art, and are thus not described in detail.

In order to move movable copy support surface 30 between the use and nonuse positions, a suitable cam means 50 is provided. Cam means 50 includes a pair of cam surfaces 52*a* and 52*b* which are formed by the upper edge of respective sides 46*a* and 46*b* of keyboard platform 40. Cam means 50 also includes cam followers 54*a* and 54*b* which preferably take the form of rollers 56 having a V-shaped groove around the center of the periphery thereof. As shown, rollers 56 are attached to a respective depending side 58*a* or 58*b* of movable copy support surface 30 adjacent flange 36. In addition, in order to urge movable copy support surface 30 to the nonuse position, a spring 60 is mounted between a suitable pin 62 extending from side 16*b* and a corresponding pin 64 extending from side 58*b*.

In order to prevent keyboard platform 40 from moving when a keyboard platform is in the use position, and to hold movable copy support surface 30 in the use position, a holding means 66 is provided. Holding means 66 includes a notch 68 on each cam surface 52*a* and 52*b*. Each notch 68 is shaped to receive a respective roller 56 therein and to thus provide a resting place for each roller 56 which holds keyboard platform 40 in the use position. It should also be appreciated that keyboard platform 40 further includes a palm rest 70 at the forward end thereof.

In operation, mounting stand 10 functions in the following manner. Initially, mounting stand 10 is assembled on a table 12 as depicted in FIG. 1. As assembled, keyboard 38 rests on keyboard platform 40 beneath fixed copy support surface 22. Keyboard 38 is enclosed in mounting stand 10 and movable copy support surface 30 forms a door or cover in front of keyboard 38. CRT display screen 28 is also mounted on screen platform 18.

In order to make use of keyboard 38, palm rest 70 is simply grasped by the user and pulled forward. As this occurs, keyboard platform 40 is pulled horizontally forward by guide mechanisms 44. As keyboard platform 40 is drawn forward, rollers 56 ride along cam surfaces 52*a* and 52*b* of sides 46*a* and 46*b*, respectively. This causes movable copy support surface to pivot about hinge means 34. As rollers 56 reach the upper horizontal edge of cam surfaces 52*a* and 52*b*, movable copy support surface 30 and fixed copy support surface 22 form a substantially continuous plane on which a suitable copy material is rested. It should be appreciated that keyboard platform 40 is pulled forward until rollers 56 descend into respective notches 68 in cam surfaces 52*a* and 52*b*. This causes keyboard platform 40 to be positively held in this position.

During use of keyboard 38, keyboard platform 40 is held in a position by holding means 66. Thereafter, when it is desired to return keyboard platform 40 to the storage position, palm rest 70 is pushed horizontally backward toward base 14 with sufficient force to cause rollers 56 to ride up out of notches 68 and back along cam surfaces 52*a* and 52*b*. When keyboard platform 40 is returned underneath of fixed copy support surface 22, movable copy support surface 30 is thus returned to the nonuse position covering keyboard platform 40 and keyboard 38 thereon. It should be appreciated that in addition to the force of gravity pulling movable copy support surface 32 to the nonuse position, spring 60 also causes movable copy support surface to be drawn to this position and maintained in this position.

Figure 4:
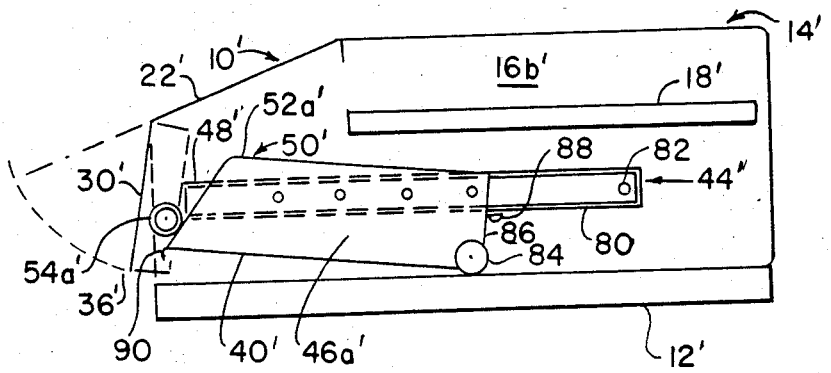
FIG. 4 is a side elevation view with the side removed of an alternative embodiment of a mounting stand according to the present invention in the nonuse position.
Figure 5:
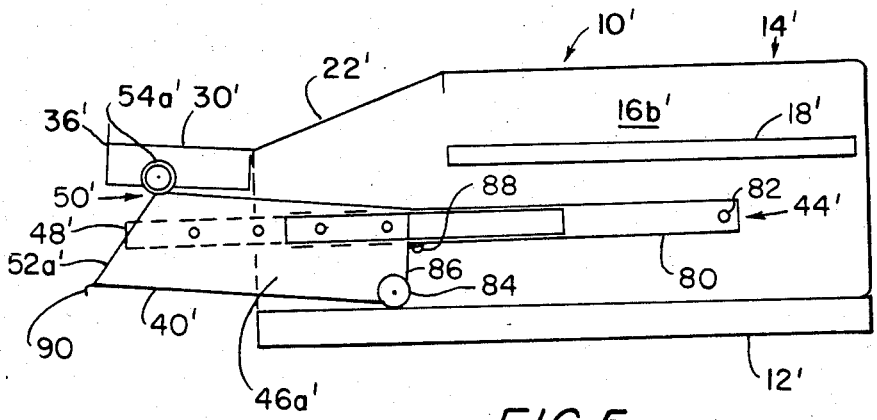
FIG. 5 is a side elevation view with the side removed of the mounting stand depicted in FIG. 4 in transition between the use and nonuse positions.
Figure 6:
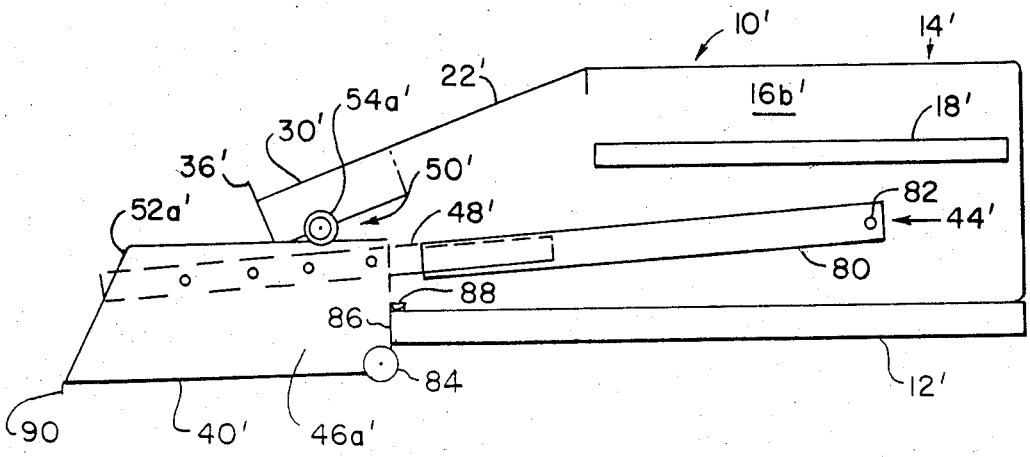
FIG. 6 is a side elevation view with the side removed of the mounting stand depicted in FIGS. 4 and 5 in the use position.

Depicted in FIGS. 4, 5, and 6 is an alternative embodiment of mounting stand 10'. Mounting stand 10' is broadly similar to mounting stand 10 and thus like elements in mounting stand 10' will be identified with the like numerals used to identify the elements in mounting stand 10 with the addition of a "'". Thus, mounting stand 10' includes a base 14' mounted on a table 12'. Base 14' has a pair of sides such as side 16*b'* depicted. A screen platform 18' and a fixed copy support 22' are also provided. Movably attached to fixed copy support surface 22' is a movable copy support surface 30'.

Movably attached to base 14' is a keyboard platform 40' which is mounted to the respective sides of base 14' by a mounting means 42'. In this embodiment of the present invention, mounting means 42' includes guide mechanisms 44'. Guide mechanisms 44' include a U-shaped slide 48' which is securely attached to side 46*a'* as shown. Guide mechanism 44' also includes a U-shaped channel 80 in which U-shaped slide 48' is slidably received. U-shaped channel 80 is pivotally secured to the associated side of base 14' only about a pivot mounting 82. Thus, U-shaped channel 80 does not hold keyboard platform 40' above the surface of table 12'. In order to mount keyboard platform 40' for movement along table 12' a pair of wheels 84 (only one of which is shown) are mounted at the respective rear corners of keyboard platform 40'.

In this embodiment of mounting stand 10', keyboard platform 40' is mounted for vertical movement as well as horizontal movement as shown in FIGS. 4 to 6. In order to limit the vertical movement of keyboard platform 40', keyboard platform 40' is provided with a back 86 from which a stop means 88 extends rearwardly. Conveniently, stop means 88 is a rubber bumper or the like. Keyboard platform 40 also includes a finger hold 90 at the forward end thereof. As shown, finger hold 90 is formed by a depending, backwardly curved flange.

Mounting stand 10' also includes a cam means 50' similar to cam means 50' of mounting stand 10'. Cam means 50' includes a cam surface 52*a'* and a cam follower 54*a'*.

In operation, mounting stand 10' functions in the following manner. As depicted in FIG. 4, mounting stand 10' is initially assembled with a suitable keyboard located on keyboard platform 40' and a suitable display screen mounted on screen platform 18'. When it is desired to use the keyboard, movable copy support surface 30' is merely lifted slightly until the user grasps finger hold 90. The user then simply pulls finger hold 90 horizontally to pull keyboard platform 40' from beneath fixed copy support surface 22' as shown in FIG. 5. As this occurs, keyboard platform 40' rides on wheels 84. In addition, movable copy support surface 30' is moved to the position depicted in FIG. 5.

At the edge of table 12', wheels 84 ride down the edge of table 12' and keyboard platform 40' is thus moved vertically. The vertical movement of keyboard platform 40' is limited by the engagement of stop means 88 with the top of table 12' as shown in FIG. 6. In this position, it should be appreciated that movable copy support surface 30' is inclined at the same angle as fixed copy support surface 22' to form a continuous plane therewith for copy support. It should also be appreciated that the vertical movement of keyboard platform 40' is allowed by the pivotal mounting 82 of U-shaped channel 80. In order to return keyboard platform 40' to the storage position, keyboard platform 40' is simply lifted by the user somewhat until wheels 84 contact the top of table 12'. At this time, keyboard platform 40' is pushed horizontally back into base 14' by pushing on finger hold 90. This continues until keyboard platform 40' is in the storage position and movable copy support surface 30' returns to the nonuse position covering keyboard platform 30'.

In order to accomodate a variety of CRT display screens, it should be appreciated that the screen platform 18 or 18' can be adjustably mounted between the sides of the base. Such adjustable mounting means are well known to those of ordinary skill in the art. With such an adjusting means, it is always possible to mount the display screen so that the upper edge of the fixed copy support surface does not interfere with the viewing of the display screen.

Although the present invention has been described with respect to exempliary embodiments thereof, it will be understood by those of ordinary skill in the art that variations and modifications can be effected within the scope and spirit of the invention.

I claim:

1. A mounting stand for a cathode ray tube display screen device and a keyboard work station comprising:

a base defining a front and back and including (a) two vertical sides, (b) a screen device platform mounted horizontally between said sides at the back of the base on which the display screen device rests, and (c) a fixed copy support surface mounted between said sides in front of said screen device platform and inclined downwardly from an upper rear edge to a lower front edge, said screen device platform being located at a height with respect to said fixed copy support surface such that the display screen of a screen device mounted on the screen device platform would be located at a height above said upper rear edge of the fixed copy support surface;

a movable copy support surface including a lower lip and an upper edge;

a hinge means for hingedly mounting said upper edge of said movable copy support surface to said lower front edge of said fixed copy support surface for pivotal movement of said movable copy support surface between a use position and a nonuse position, the said use position being that position of the said movable copy support surface where it is at substantially the same downward forward angle of inclination as said fixed copy support surface and forming with the fixed copy support surface a substantially continuous supporting surface and the nonuse position being that position of said movable copy support surface where it is angled with respect to said fixed copy support surface;

a holding means for holding said movable copy support surface in the use position; and a keyboard supporting means for supporting the keyboard in front of said movable copy support surface when said movable copy support surface is in the use position.

2. A mounting stand as claimed in claim 1 wherein said keyboard supporting means includes a horizontal keyboard platform and a mounting means for mounting said keyboard platform for horizontal movement from a use position in front of said movable copy support surface when said movable copy support is in the use position to a storage position beneath said fixed copy support surface when said movable copy support surface is in the nonuse position; and wherein said nonuse position of said movable copy support surface is downwardly from the use position whereby said movable copy support surface covers and protects the keyboard on said keyboard platform in the storage position.

3. A mounting stand as claimed in claim 2 wherein said keyboard platform includes opposite sides, and wherein said mounting means movably mounts respective said sides of said keyboard platform to respective said sides of said base.

4. A mounting stand as claimed in claim 2 wherein said holding means includes a cam means for moving said movable copy support surface between said use position and said nonuse position and for holding said movable copy support surface in said use position, said cam means including a cam surface mounted on said keyboard platform and a cam follower mounted on said movable copy support surface.

5. A mounting stand as claimed in claim 4 wherein said keyboard platform includes opposite sides, and wherein said mounting means movably mounts respective said sides of said keyboard platform to respective said sides of said base.

6. A mounting stand as claimed in claim 5 wherein there are two said cam surfaces, each said cam surface being formed by the upper edge of a respective said side of said keyboard platform; and wherein there are two said cam followers, each said cam follower located vertically above a respective said cam surface.

7. A mounting stand as claimed in claim 6 wherein said keyboard platform further includes an upwardly directed palm rest at the forward end thereof.

8. A mounting stand as claimed in claim 6 wherein said holding means includes a notch in each said cam surface in which respective said cam followers descend to thereby hold said movable copy support surface in the use position.

9. A mounting stand as claimed in claim 8 wherein said holding means further includes a spring means for resiliently urging said movable copy support surface to the nonuse position and for resiliently urging said cam followers into respective said notches.

10. A mounting stand as claimed in claim 2 wherein said mounting means also mounts said keyboard platform for vertical movement such that the use position of said keyboard platform is vertically lower than the storage position of said keyboard platform.

11. A mounting stand as claimed in claim 10 wherein said keyboard platform includes opposite sides, and wherein said mounting means movably mounts respective said sides of said keyboard platform to respective said sides of said base.

12. A mounting stand as claimed in claim 11 wherein the mounting stand is located on a table with said movable copy support surface in the nonuse position adjacent an edge of the table; and wherein said keyboard platform further includes a back and a stop means extending rearwardly from said back such that the use position of said keyboard platform is where said stop means engages the table edge.

13. A mounting stand as claimed in claim 12 wherein said keyboard platform further includes a roller at the rearward and lowermost end thereof.

14. A mounting stand as claimed in claim 13 wherein said holding means includes a cam means for moving said movable copy support surface between said use position and said nonuse position and for holding said movable copy support surface in said use position, said cam means including a cam surface mounted on said keyboard platform and a cam follower mounted on said movable copy support surface.

15. A mounting stand as claimed in claim 14 wherein there are two said cam surfaces, each said cam surface being formed by the upper edge of a respective said side of said keyboard platform; and wherein there are two said cam followers, each said cam follower located vertically above a respective said cam surface.

16. A mounting stand as claimed in claim 15 wherein said keyboard platform further includes a downwardly directed finger hold at the forward end thereof.

17. A mounting stand for a cathode ray tube screen device and a keyboard work station comprising, a support means, a copy support surface mounted on the support means and located at the upper front of the stand and extending at an angle upwardly and rearwardly, a screen device platform mounted on the support means and located rearwardly of the copy support surface and extending generally horizontally, means for movably mounting a keyboard for movement between a stored position beneath the copy support surface and an operating position forward of the copy support surface, said copy support surface including an upper portion fixedly mounted to the support means and a lower portion hinged to the upper portion, said lower portion movable between a raised position coplaner with the upper portion to form the full copy support surface when the keyboard is moved to the operating position and a lowered position to form a front cover of the mounting stand when the keyboard is moved to a stored position.

18. A mounting stand as claimed in claim 17 and further including a cam means for moving said lower portion from the lowered position to the raised position as said screen platform is moved from the stored position to the operating position, and for moving said lower portion from the raised position to the lowered position as said screen platform is moved from the operating position to the storage position.

19. A mounting stand as claimed in claim 18, wherein the operating position of the keyboard is also displaced vertically downward from the stored position, and wherein said mounting means further. movable mounts said keyboard for movement between the stored position and the operating position which is displaced vertically downward from the stored position.

* * * * *